United States Patent [19]

Flemings et al.

[11] 4,372,369

[45] Feb. 8, 1983

[54] CONTINUOUS PROCESS FOR FORMING SHEET METAL FROM AN ALLOY CONTAINING NON-DENDRITIC PRIMARY SOLID

[75] Inventors: Merton C. Flemings, Cambridge, Mass.; Tooru Matsuniya, Kawasaki, Japan

[73] Assignee: Massachusetts Institute of Technology, Cambridge, Mass.

[21] Appl. No.: 188,645

[22] Filed: Sep. 19, 1980

[51] Int. Cl.[3] ..... B22D 11/06

[52] U.S. Cl. ..... 164/482; 164/900

[58] Field of Search ..... 164/71.1, 417, 427, 164/429, 476, 479, 900, 480–482

[56] References Cited

U.S. PATENT DOCUMENTS 2,348,178 5/1944 Merle ..... 164/429 X 3,902,544 9/1975 Flemings et al. ..... 164/900 X

*Primary Examiner*—Gus T. Hampilos

*Assistant Examiner*—K. Y. Lin

[57] ABSTRACT

A homogeneous mixture of liquid-solid metal is shaped by passing the composition from an agitation zone onto a surface moving relative to the exit of the agitation zone. A portion of the composition contacting the moving surface is solidified and the entire composition then is formed.

5 Claims, 2 Drawing Figures

CONTINUOUS PROCESS FOR FORMING SHEET METAL FROM AN ALLOY CONTAINING NON-DENDRITIC PRIMARY SOLID

BACKGROUND OF THE INVENTION

The invention herein described was made in the course of work supported by the Department of Energy, Institutional Agreement No. EX-76-A-01-2295, Task Order No. 44.

The present invention relates to a continuous process for forming strip metal from a metal alloy containing liquid and non-dendritic solid. A continuous process for forming homogeneous mixtures of a liquid-solid composition wherein the solid component comprises discrete degenerate dendrites or nodules is disclosed in U.S. Pat. No. 3,902,544, issued Sept. 2, 1975. As disclosed in that patent, a metal composition is melted and then passed into an agitation zone wherein it is vigorously agitated and cooled to solidify a portion of the liquid and to form primary solids comprising discrete degenerate dendrites while preventing the formation of an interconnected dendritic network in the agitation zone. The resultant liquid-solid metal composition then is formed such as by pouring, injection, molding, continuous casting, etc. While a variety of forming processes is disclosed in the patent, there is no forming process disclosed which is suitable for forming strip metal from metal alloys which melt within a high temperature range such as steels. High temperature alloys are difficult to cast continuously such as by in-line reduction wherein the alloy, either in its partially solidified state or just at the completion of solidification, is subjected to progressively higher squeezing pressures to reduce its diameter and to form a sheet, rod or the like. When high temperature alloys are subjected to these prior art processes, the resultant product is characterized by service cracks or cracks near the surface even though internal cracks, center porosity or pinholes are eliminated by welding under the in-line reduction pressures. Also, in present in-line reduction process, it is difficult to prevent accumulation of solute-rich liquid in the later-formed portions of the final product which resulted in a product having heterogeneous composition. In present processes for forming sheets or rods from a liquid metal, a common problem which is encountered is the formation of porous areas at or near the center line of the finally formed product. During formation of the product, shrinkage occurs within the interior of the product and liquid metal cannot migrate sufficiently quickly to the center portion of the product to prevent formation of these pores.

Accordingly, it would be desirable to provide a process for forming sheets or the like from metal compositions so that the product formed does not have the mechanical and/or composition nonhomogeniety which is characterized by prior art processes. Furthermore, it would be desirable to provide such a process which is capable of forming such products from high melting alloys such as steels.

SUMMARY OF THE INVENTION

The present invention provides a process for forming and shaping a metal composition containing degenerate dendritic primary solid particles homogeneously suspended in a secondary phase having a lower melting point than the primary solids and having a different metal composition than the primary solids wherein both the secondary phase and the primary solids are derived from the same alloy. These compositions are formed by first vigorously agitating a solid-liquid mixture of the alloy to convert the solid portion thereof to degenerate dendritic primary solid particles. The resultant liquid-solid composition is continuously fed onto a flat surface which is moved relative to the flow path of the liquid-solid composition. After being deposited upon the flat surface, heat is extracted from the liquid-solid composition, preferentially by conduction into the material forming the moving flat surface. The partially solidified metal on the flat surface then is subjected to pressure such as being passed between rollers in order to form the desired final solid product. By controlling the rate of deposition of the metal onto the moving flat surface, the speed of the flat surface, the fraction of primary solid and the deformation forces to which the partially solidified metal alloy is subjected, a final product free of cracks and center line porosity can be formed.

DESCRIPTION OF SPECIFIC EMBODIMENTS

Figure 1:
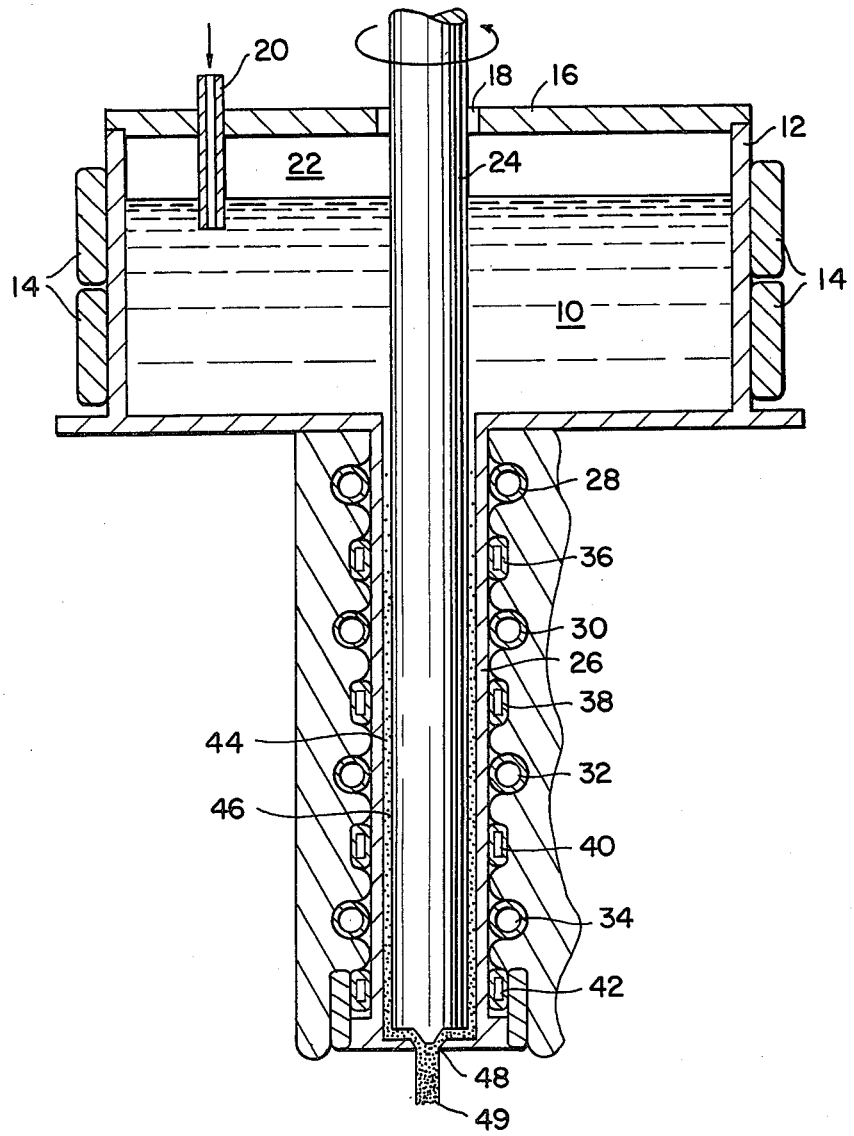
FIG. 1 is a cross-sectional view of an apparatus suitable for forming liquid-solid metal compositions.

By the term "primary solid" as used herein is meant the phase or phases solidified to form discrete degenerate dendrite particles as the temperature of the melt is reduced below the liquidus temperature of the alloy into the liquid-solid temperature range prior to forming the liquid-solid slurry. By the term "secondary solid" as used herein is meant the phase or phases that solidify from the liquid existing in the slurry at a lower temperature than that at which the primary solid particles are formed after agitation ceases. The primary solids obtained in the metal compositions formed by the process of this invention differ from normal dendrite structures in that they comprise discrete particles suspended in the remaining liquid matrix. Normally solidified alloys, in absence of agitation, have branched dendrites separated from each other in the early stages of solidification, i.e., up to 15 to 20 wt. percent solid, and develop into an interconnected network as the temperature is reduced and the weight fraction solid increases. The structure of the compositions formed by the process of this invention on the other hand prevents formation of the interconnected network by maintaining the discrete primary particles separated from each other by the liquid matrix even up to solid fractions of 60 to 65 wt percent. The primary solids are degenerate dendrites in that they are characterized by having smoother surfaces and less branched structures which approaches a spherical configuration than normal dendrites and may have a quasi-dendritic structure on their surfaces but not to such an extent that interconnection of the particles is effected to form a network dendritic structure. The primary particles may or may not contain liquid entrapped within the particles during particle solidification depending upon severity of agitation and the period of time the particles are retained in the liquid-solid range. However, the weight fraction of entrapped liquid is less than that existing in a normally solidified alloy at the same temperature employed in present processes to obtain the same weight fraction solid.

The secondary solid which is formed during solidification from the liquid matrix subsequent to forming the primary solid contains one or more phases of the type which would be obtained during solidification of a liquid alloy of identical composition by presently employed casting processes not employing vigorous agitation. That is, the secondary solid can comprise dendrites, single or multiphase compounds, solid solutions, or mixtures of dendrites, compounds and/or solid solutions.

The size of the primary particles depends upon the alloy or metal compositions employed, the temperature of the solid-liquid mixtures and the degree of agitation employed with larger particles being formed at lower temperature and when using less severe agitation. Thus, the size of the primary particles can range from about 1 to about 10,000 microns. It is preferred that the composition contain between about 30 and 80 weight percent primary particles since they have a viscosity which promotes ease of forming without causing heat damage to the forming apparatus.

As employed herein, the terms "agitation" or "vigorous agitation" as applied to the process of this invention mean that the liquid-solid composition is subjected to an agitation force sufficient to prevent the formation of interconnected dendritic networks and to substantially eliminate or reduce dendritic branches already formed on the primary solid particles.

A metal alloy is rendered molten in a first zone which is in communication with an agitation zone. The agitation zone is connected to the first zone and is sealed to prevent entrainment of gas into the metal composition therein. The agitation zone is provided with means for cooling the metal composition therein and for vigorously agitating the metal composition therein. The degree of agitation in the agitation zone must be sufficient to prevent the formation of interconnected dendritic networks from the metal composition while it is cooled. The particular means employed for providing the degree of agitation is not critical so long as the interconnected dendritic networks are not formed and the primary solids are formed while the metal composition therein is cooled. The primary solids content of the metal composition in the agitation zone can comprise up to about 80 wt. percent of the liquid-solid metal composition. The liquid-solid metal composition is removed from the agitation zone through an outlet at about the same rate as the molten composition is passed into the agitation zone.

The liquid-solid metal composition is directed from the outlet of the agitation zone by gravity onto a surface which is cooler than the metal composition. The relatively cool surface moves in a generally horizontal direction relative to the flow of the liquid-solid composition from the agitation zone outlet. By operating in this manner, the liquid-solid composition is deposited as a relatively thin layer on the moving surface and, after having been deposited, immediately begins to cool by virtue of conduction through the moving surface from the heated liquid-metal composition. This cooling effects the formation of the relatively thin layer of solid metal in contact with the moving surface prior to subjecting the liquid-solid metal composition to pressure to effect forming. It is not necessary to maintain the moving surface horizontal. The surface, relative to the metal flow from the agitation, need only be at an angle to promote the preliminary solidification without excessive spilling from the surface edges. The partially cooled and solidified metal then is subjected to pressure such as by being passed between moving rollers to form a flat sheet, rod or the like.

Any metal alloy system regardless of its chemical composition can be employed in the process of this invention. Representative suitable alloys include magnesium alloys, zinc alloys, aluminum alloys, copper alloys, iron alloys, nickel alloys, cobalt alloys and lead alloys such as lead-tin alloys, zinc-aluminum alloys, zinc-copper alloys, magnesium-aluminum alloys, magnesium-aluminum-zinc alloys, magnesium-zinc alloys, aluminum-copper alloys, aluminum-silicon alloys, aluminum-copper-zinc-magnesium alloys, copper-tin bronzes, brass, aluminum bronzes, steels, cast irons, tool steels, stainless steels, superalloys such as nickel-iron alloys, nickel-iron-cobalt-chromium alloys, and cobalt-chromium alloys.

Referring to FIG. 1, a metal alloy in the liquid state 10 is retained within container 12. The metal alloy 10 can be heated to the liquidus state or maintained at or above the liquidus temperature by means of band heaters 14 which are positioned above the circumference of container 12. A cover 16 having a central hole 18 is placed on container 12 and, if desired, a conduit 20 can be extended through the cover 16 in order to introduce an inert gas into the container 12 and to provide an inert gas atmosphere 22 above the molten metal 10. An agitation rotor 24 extends through the hole 18, through the liquid metal 10 and into agitation zone 26. By maintaining a head of liquid metal 10 above agitation zone 26, gas is prevented from entering agitation zone 26. Rotor 24 is powered by any conventional means (not shown). Heating coils, 28, 30, 32 and 34 and cooling coils 36, 38, 40 and 42 surround agitation zone 26 in order to provide control for the amount of heat and the temperature of the metal alloy within the agitation zone 26. The distance between the inner surface 44 of agitation zone 26 and the outer surface 46 of rotor 24 is maintained sufficiently small so that high shear forces can be applied to a liquid-solid mixture in the agitation zone 26 sufficient to prevent the formation of interconnected dendritic networks while at the same time allowing passage of the liquid-solid mixture through the agitation zone 26. The bottom surface of agitation zone 26 is provided with an opening 48 so that the liquid-solid mixture 49 can be removed by gravity or, if desired, by establishing a pressure differential between upper surface of molten metal 10 and opening 48.

Figure 2:
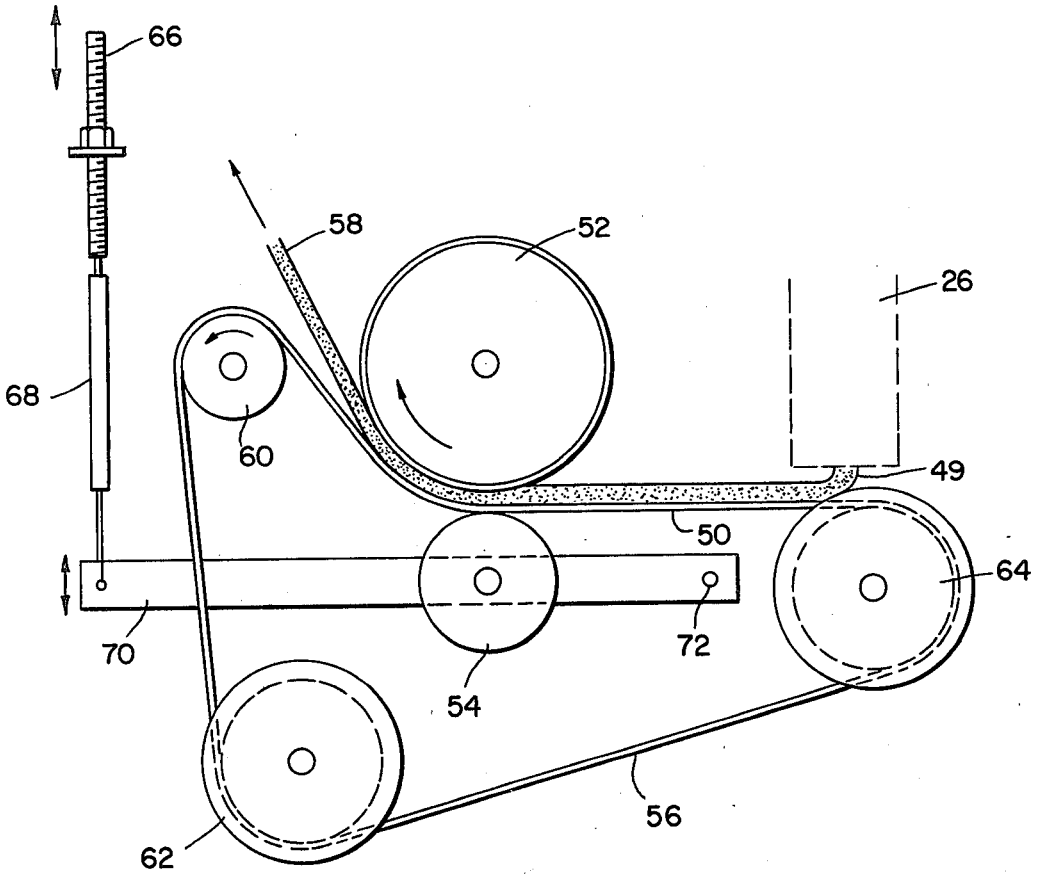
FIG. 2 is a side-view of an apparatus suitable for forming liquid-solid metal compositions in accordance with this invention.

As shown in FIG. 2, the liquid-solid mixture 49, emerging from agitation zone 26, is fed onto moving belt 56 at a point sufficiently far from rollers 52 and 54 so that the mixture travels a flat segment of the belt 50 before being subjected to pressure. While on flat segment 50, the liquid-solid mixture in contact with the belt and immediately adjacent thereto is preferentially cooled to form a thin solid layer. The liquid-solid mixture then is passed between driven roller 52 and backup roller 54 wherein it is subjected to pressure to form a solidified thin sheet 58. The endless belt 56 passes about driving roller 60 and pulleys 62 and 64. The pressure to which the liquid-solid mixture is subjected can be adjusted by adjusting screw 66 attached to spring scale 68 which in turn is attached to lever 70 attached to pivot 72. The sheet product 58 then can be treated in a conventional manner such as being stored on a roll or cut into finite flat sheets.

The following example illustrates the present invention and is not intended to limit the same.

EXAMPLE I

Utilizing the apparatus shown in the figures, under the conditions set forth in Table I, the results set forth below were obtained.

Sn-15% Pb alloy was used as the modeling alloy, since its rheology has been studied extensively. The alloy was prepared from commercially pure tin and pure lead, with a total impurity content under about 0.05%. The semi-solid alloy was produced from the molten alloy in a continuous Rheocaster, which is shown in FIG. 1. The Rheocaster mainly consists of a reservoir, a mixing chamber, and a rotor, which are all made of stainless steel. The mixing chamber is a cylinder with 33.5 mm inner diameter. The rotor is a 25.4 mm×25.4 mm square column with the four corners cut off to fit into the mixing chamber.

During casting, the alloy passes down the mixing chamber, where it is cooled down to a desired fraction solid by cooling coils, and simultaneously agitated by the rotation of the rotor. The flow rate of the alloy is controlled by the clearance between the bottom of the rotor and the bottom surface of the mixing chamber, and by the alloy viscosity. The rotor is driven by a variable speed A.C. motor. In this way, Rheocast semi-solid alloy was obtained. Average production rate was 11 g/sec.

The semi-solid alloy was fed onto a silicone rubber belt of the strip caster shown in FIG. 2. It was deformed into sheet between the rubber and a main roll, and straightened by hand. Deformation force was controlled by tension of the rubber and by the application of a back-up roll beneath the belt. The main roll was 16.8 cm in diameter, lined with silicone rubber. The back-up roll was attached to a lever and the loading to the roll was varied by the length of a spring scale through which the lever was supported.

The effects of process parameters, including deformation force (or amount of deformation), fraction solid, rotor rate and belt speed on structure, homogeneity of composition, surface quality, crack formation and shape of the sheet produced were studied. Loading on the back-up roll was varied from 0 to 6.3 kgf in six ways, mainly for the alloy with fraction solid 0.6 produced at belt speed 9.0 cm/sec and rotor rate of 800 rpm. Rotor rate varied for the alloy with fraction solid 0.6 at 400, 600 and 800 rpm. Fraction solid was varied from 0.40 to 0.80 with rotor rate of 800 rpm. Fraction solid was monitored by observing flow behavior of the semi-solid alloy, but the precise fraction solid was later calculated by point counting the fraction of primary solid on a cross-sectional micrograph of a water-quenched specimen. Belt speed was 9 cm/sec, but 4.5 cm/sec was also used for the alloy with fraction solid 0.6 produced at rotor rate of 800 rpm. The alloys were deformed in three different ways; with no edger and back-up roll loading 3.78 kgf, with low edgers (1.4 mm or 1.7 mm high) and loading 1.26 kgf, and with high edgers (3.1 mm high) and loading 1.26 kgf. The edgers were of silicone rubber, mounted at both ends of the main roll surface.

Microstructure of the sheet produced was studied at various cross-sections but mainly transverse cross-sections. Since it was observed that more eutectic was found in the edge of the sheet than the center, local chemical analysis was conducted by X-ray fluorescence analysis. The sheet was sectioned into three parts: center, edge and intermediate, and remelted separately in an argon atmosphere. Then samples were quench-cast for X-ray fluorescence analysis. From the intensity measurement of lead Lα, Pb content was obtained.

Liquid alloy was also charged on the belt and deformed into sheet during its solidification (fraction solid 0.15) in the strip caster. The result was compared with the deformation of the semi-solid alloy.

Temperature was measured in the semi-solid metal as it passed through the strip caster. The thermocouple used for measurement had a 1.0 mm diameter insulated tip and 0.2 mm diameter chromel-alumel wire. It was put in the semi-solid alloy just below the outlet of the Rheocaster. While traveling within the metal stream, the thermocouple recorded the thermal histroy as the metal passed through the roll gap and solidified downstream.

A variety of different combinations of casting configurations and casting parameters were tested in this work. Best results were obtained using fraction solid between 0.50 to 0.70, deformation force less than 3.8 kgf, and silicone rubber main roll surface in the curved-casing and straightening strip caster for both belt speed 4.5 and 9.0 cm/sec. With these conditions, sound sheet with good surface quality was obtained. However, when the final sheet thickness exceeded 2.0 mm, breaking of the sheet at the straightening point often occurred.

When a cold steel surface was used as main roll surface, transverse cracks resulted in the sheet. When fraction solid below 0.50 was used, deterioration of the silicone rubber occurred and a rough surface resulted due to bubble formation from gasification of the rubber. On the other hand, when fraction solid exceeded 0.75, many cracks resulted in the sheet from the deformation. In the case of this high fraction solid, when the feeding of the Rheocaster was faster than the belt speed, a wavy pattern of the feeding resulted on the belt and straight strip could not be produced. When the deformation force exceeded 3.8 kgf, two parallel longitudinal cracks resulted in the sheet. Finally, a slight reduction of surface quality was observed as rotor rate was reduced.

As deformation force is increased, sheet thickness decreases; sheet thickness increases as fraction solid increases. Associated with this increment of the sheet thickness, reduction ratio ($R_r$) decreases from 0.80 to 0.5 and aspect ratio of the sheet ($R_a$) decreases from 46 to 7.5. This considered to be due to the increasing viscosity of the semi-solid and increasing thickness of solid layers formed before the deformation is completed. As sheet thickness slightly decreases, rotor rate increases. Concomitantly, $R_r$ increases from 0.46 to 0.54 and $R_a$ increases from 6 to 8 on average. Sheet thickness increases as belt speed is reduced. It is because thickness of solid layer formed before deformation is completed becomes larger and thixotropy increases due to the longer conveyance time on the belt. Concomitantly, $R_r$ decreases from 0.52 to 0.44 and $R_a$ decreases from 8 to 6 on average.

The runs conducted illustrate certain advantages of the use of the semi-solid over the use of pure liquid as charge material for a strip caster. First, the deterioration of the silicone rubber did not occur when the semi-solid with fraction solid more than 0.50 was used. Second, the semi-solid did not flow off the belt because of its thixotropical nature. In addition, the advantages of the Rheocast semi-solid over conventionally cast dendritic semi-solid were observed by comparison of the structure of the sheets obtained using both kinds of semi-solid alloy. When deforming conventionally cast semi-solid alloy, excessive segragetion of eutectic phase is observed and many interdendritic or intergranular cracks are observed. They are not observed in the sheet produced by defoming the semi-solid alloy degenerated dendrites utilized in this invention under the conditions stated above.

TABLE I

EXPERIMENTAL DATA

| No. | $f_s$ % | Load kgf | Edger | Cross Section of the Sheet | Line Speed cm/sec | $R_r$ Reduction Ratio | $R_a$ Aspect Ratio | Feeding Rate g/sec | Rotor Rate rpm |
|---|---|---|---|---|---|---|---|---|---|
| 1 | 54 | 0.38 | no | 10.6 × 1.8(1.4) | 9.0 | 0.45 | 6.05 | 11.8 | 800 |
| 2 | 66 | 0.38 | no | 10.3 × 1.55(1.25) | 9.0 | (0.48) | 6.65 | 10.0 | 800 |
| 3 | 71 | 1.26 | no | 12.6 × 1.5(1.1) | 9.0 | 0.58 | 8.40 | 11.4 | 800 |
| 4 | 55 | 1.26 | no | 10.0 × 1.7(1.6) | 9.0 | 0.43 | 5.88 | 11.5 | 800 |
| 5 | 66 | 2.53 | no | 11.7 × 1.5(1.25) | 9.0 | 0.50 | 7.80 | 11.2 | 800 |
| 6 | 64 | 2.53 | no | 15.8 × 1.6(1.2) | 9.0 | — | 9.88 | 15.4 | 800 |
| 7 | 62 | 2.53 | no | 34.0 × 1.5(1.5) | 9.0 | — | 22.67 | 31.9 | 800 |
| 8 | 50 | 3.79 | no | 18.0 × 1.1(0.8) | 9.0 | 0.69 | 16.36 | 11.9 | 800 |
| 9* | 56 | 3.79 | no | 13.4 × 1.9(1.2) | 9.0 | 0.37 | 7.05 | 14.4 | 800 |
| 10 | 63 | 3.79 | no | 22.0 × 1.6(1.1) | 9.0 | 0.53 | 13.75 | 20.6 | 800 |
| 11 | 50 | 3.79 | no | 18.3 × 1.7(1.0) | 9.0 | 0.43 | 10.76 | 17.2 | 800 |
| 12* | 57 | 3.79 | no | 12.5 × 1.7(0.8) | 9.0 | 0.48 | 7.35 | 10.9 | 800 |
| 13** | 56 | 6.32 | no | 10.8 × 1.2(0.7) | 9.0 | (0.69) | 9.00 | 7.1 | 800 |
| 14** | 51 | 6.32 | no | 12.7 × 1.7(0.9) | 9.0 | 0.47 | 7.47 | 11.5 | 800 |
| 15 | 67 | 3.79 | no | 13.2 × 2.5(2.1) | 4.5 | 0.44 | 5.28 | 10.8 | 800 |
| 16 | 57 | 6.32 | no | 10.4 × 2.4(1.8) | 4.5 | 0.38 | 4.33 | 7.6 | 800 |
| 17 | 64 | 3.79 | no | 13.5 × 1.55(1.0) | 9.0 | 0.57 | 8.71 | 12.0 | 800 |
| 18 | 56 | 3.79 | no | 12.0 × 1.4(0.8) | 9.0 | 0.50 | 8.57 | 9.2 | 800 |
| 19 | 57 | 1.26 | $1^-$ | 13.0 × 1.3(1.3) | 9.0 | 0.64 | 10.00 | 11.7 | 800 |
| 20 | 66 | 1.26 | $1^-$ | 13.0 × 1.35(1.25) | 9.0 | 0.55 | 9.63 | 11.7 | 800 |
| 21 | 64 | 1.26 | $1^+$ | 11.5 × 1.6(1.45) | 9.0 | 0.54 | 7.19 | 12.2 | 800 |
| 22 | 54 | 1.26 | $1^+$ | 8.7 × 1.6(1.45) | 9.0 | 0.45 | 5.44 | 9.2 | 800 |
| 23 | 51 | 1.26 | 2 | 7.5 × 2.5(2.2) | 9.0 | 0.31 | 3.00 | 12.2 | 800 |
| 24 | 64 | 1.26 | 2 | 5.0 × 2.6(2.4) | 9.0 | 0.26 | 1.92 | 8.7 | 800 |
| 25 | 62 | 1.26 | 2 | 9.2 × 2.35(2.35) | 9.0 | 0.33 | 3.91 | 15.0 | 800 |
| 26 | 59 | 1.26 | 2 | 9.7 × 2.35(2.35) | 9.0 | 0.35 | 4.13 | 15.8 | 800 |
| 27 | 74 | + | no | 6.6 × 3.0(2.9) | 9.0 | 0.27 | 2.20 | 13.5 | 800 |
| 28*** | 75 | + | no | 5.2 × 3.6(3.5) | 9.0 | 0.20 | 1.44 | 12.8 | 800 |
| 29*** | 81 | 1.26 | no | 2.8 × 2.5(2.2) | 9.0 | 0.38 | 1.12 | 4.6 | 800 |
| 30*** | 80 | 1.26 | no | 5.5 × 3.0(2.7) | 9.0 | 0.25 | 1.83 | 10.9 | 800 |
| 31*** | 84 | 1.26 | no | 6.8 × 2.5(2.2) | 9.0 | 0.40 | 2.72 | 11.1 | 800 |
| 32*** | 76 | 1.26 | no | 6.8 × 2.6(2.2) | 18.0 | 0.42 | 2.62 | 22.7 | 800 |
| 33*** | 81 | 1.26 | no | 5.8 × 2.15(1.9) | 18.0 | 0.45 | 2.70 | 16.3 | 800 |
| 34*** | 80 | 1.26 | no | 6.1 × 2.6(2.1) | 18.0 | 0.32 | 2.35 | 19.9 | 800 |
| 35*** | 75 | 1.26 | $1^+$ | 7.2 × 2.1(1.9) | 18.0 | 0.48 | 3.42 | 20.0 | 800 |
| 36 | 47 | + | no | 26.0 × 1.2(0.8) | 9.0 | 0.61 | 21.70 | 18.1 | |
| 37 | 42 | + | no | 26.0 × 1.2(0.8) | 9.0 | 0.66 | 21.70 | 18.1 | |
| 38 | 39 | 3.79 | no | 23.5 × 0.7(0.5) | 9.0 | (0.77) | 33.60 | 9.8 | |
| 39 | 37 | 3.79 | no | 26.0 × 0.6(0.45) | 9.0 | 0.80 | 43.30 | 9.5 | |
| 40 | 50 | 1.26 | $1^+$ | 14.5 × 1.6(1.4) | 9.0 | (0.54) | 9.06 | 15.1 | |
| 41 | 46 | 1.26 | $1^+$ | 16.0 × 1.3(1.3) | 9.0 | 0.63 | 12.30 | 14.5 | |
| 42 | 44 | 1.26 | $1^+$ | 17.5 × 1.6(1.6) | 9.0 | 0.57 | 10.90 | 19.5 | |
| 43 | 42 | 1.26 | 2 | 6.5 × 2.6(2.6) | 9.0 | (0.24) | 2.50 | 11.7 | |
| 44 | 47 | 1.26 | 2 | 6.9 × 2.3(2.2) | 9.0 | 0.32 | 3.00 | 10.8 | |
| 45 | 53 | 3.79 | no | 14.3 × 1.3(0.8) | 9.0 | 0.64 | 11.00 | 10.4 | 600 |
| 46 | 46 | 3.79 | no | 16.0 × 1.7(1.0) | 9.0 | 0.55 | 8.42 | 18.6 | 600 |
| 47 | 60 | 3.79 | no | 12.2 × 1.7(1.0) | 9.0 | 0.54 | 7.18 | 11.4 | 600 |
| 48 | 65 | 1.26 | $1^-$ | 11.2 × 1.9(1.7) | 9.0 | 0.56 | 5.89 | 14.0 | 600 |
| 49 | 64 | 1.26 | $1^+$ | 7.6 × 1.9(1.8) | 9.0 | 0.50 | 4.00 | 9.8 | 600 |
| 50 | 59 | 1.26 | $1^+$ | 8.5 × 1.9(1.7) | 9.0 | 0.47 | 4.47 | 10.6 | 600 |
| 51 | 61 | 1.26 | 2 | 5.8 × 2.7(2.6) | 9.0 | 0.21 | 2.15 | 15.7 | 600 |
| 52 | 49 | 1.26 | 2 | 6.0 × 2.8(2.8) | 9.0 | — | 2.14 | 11.7 | 600 |
| 53 | 57 | 3.79 | no | 10.5 × 1.6(1.3) | 9.0 | — | 6.56 | 10.6 | 400 |
| 54 | 60 | 3.79 | no | 10.9 × 2.0(1.3) | 9.0 | 0.50 | 5.45 | 12.5 | 400 |
| 55 | 63 | 3.79 | no | 10.0 × 1.8(1.1) | 9.0 | 0.44 | 5.56 | 10.1 | 400 |
| 56 | 60 | 3.79 | no | 11.5 × 1.7(0.9) | 9.0 | 0.47 | 6.76 | 10.4 | 400 |
| 57 | 44 | 1.26 | $1^+$ | 14.7 × 2.1(1.95) | 9.0 | 0.54 | 7.00 | 20.7 | 400 |
| 58 | 56 | 1.26 | $1^+$ | 11.0 × 1.65(1.5) | 9.0 | 0.54 | 6.67 | 12.0 | 400 |
| 59 | 57 | 1.26 | 2 | 7.7 × 2.5(2.3) | 9.0 | — | 3.08 | 12.8 | 400 |
| 60 | 54 | 1.26 | 2 | 7.2 × 2.65(2.6) | 9.0 | 0.26 | 2.72 | 13.1 | 400 |
| 61 | 56 | 3.79 | no | 21.2 × 2.6(2.1) | 4.5 | 0.50 | 8.15 | 17.3 | 800 |
| 62 | 60 | 3.79 | no | 15.5 × 2.3(1.8) | 4.5 | 0.45 | 6.74 | 11.0 | 800 |
| 63 | 66 | 1.26 | $1^-$ | 12.0 × 2.0(1.7) | 4.5 | 0.44 | 6.00 | 7.7 | 800 |
| 64 | 62 | 1.26 | $1^-$ | 13.5 × 1.8(1.6) | 4.5 | 0.49 | 7.50 | 8.0 | 800 |
| 65 | 61 | 12.6 | $1^+$ | 10.4 × 2.3(2.0) | 4.5 | 0.47 | 4.52 | 7.8 | 800 |
| 66 | 58 | 1.26 | $1^+$ | 13.9 × 2.45(2.2) | 4.5 | 0.43 | 5.67 | 11.2 | 800 |
| 67 | 63 | 1.26 | 2 | 9.0 × 2.7(2.4) | 4.5 | 0.33 | 3.33 | 8.0 | 800 |
| 68 | 60 | 1.26 | 2 | 10.3 × 2.8(2.8) | 4.5 | 0.38 | 3.68 | 10.0 | 800 |

TABLE I-continued

EXPERIMENTAL DATA

| No. | $f_s$ % | Load kgf | Edger | Cross Section of the Sheet | Line Speed cm/sec | $R_r$ Reduction Ratio | $R_a$ Aspect Ratio | Feeding Rate g/sec | Rotor Rate rpm |
|---|---|---|---|---|---|---|---|---|---|
| 69**** | 59 | 1.26 | 2 | 8.4 × 3.3(3.1) | 4.5 | 0.27 | 2.55 | 9.0 | 800 |

*Longitudinal cracks appear (partially).
**Longitudinal cracks appear (always).
***Many cracks appear.
****Cracks appear (slightly).
+Deformed without back-up roll.
Edger height;
$1^-$: 1.4 mm,
$1^+$: 1.7 mm,
2: 3.1 mm.
Cross section of the sheet is represented as follows: width × thickness at the center (thickness at the edge).

TABLE II

| No. | Alloy Weight Before and After Deformation | |
|---|---|---|
| | Before Deformation | After Deformation |
| 18 | 0.917 g/cm | 0.931 g/cm |
| 36 | 2.138 | 2.182 |
| 46 | 2.394 | 2.118 |
| 48 | 1.306 | 1.358 |

As shown in Tables I and II, the following results were obtained.

(a) Good quality sheet was obtained for $0.5<f_s<0.75$, belt speed 4.5–9.0 cm/sec, and reduction ratio (of the semi-solid material) of about ½.

(b) Rheocaster rotor rate levels studied were 400, 600 and 800 rpm. As the rotor rate is reduced, surface quality is slightly reduced, and more eutectic is observed in the primary solid. As rotor rate decreases, sheet thickness increases and reduction ratio and aspect ratio decreases.

(c) Belt speed levels studied were 4.5 and 9.0 cm/sec. When the lower speed is applied, sheet thickness is larger and aspect ratio and reduction ratio are smaller under the same loading, and the minimum obtainable sheet thickness is larger. These phenomena are due to the thicker solidified layer formed during the longer conveyance time on the belt.

(d) Deformation forces studied were 0.6–6.32 kgf. Without edgers, when the load exceeds 3.79 kgf, longitudinal cracks appear. Without edgers, the difference in sheet thickness between the center and the edge is large. This is due to the inhomogeneous belt deformation associated with the pressure distribution. When initial fraction solid is about 0.60, if the final sheet thickness exceeds 2.0 mm, breaking of the sheet is often observed at the straightening point. As reduction ratio increases, difference in Pb content between the edge and the center increases.

We claim:

1. The method for shaping a homogeneous mixture of liquid-solid metal composition wherein said solid comprises discrete degenerate dendrites or nodules from a first metal composition which, when frozen from its liquid state, without agitation forms a dendritic structure, which comprises heating said first metal composition to melt said first metal composition in a first zone, passing the melted first metal composition into an agitation zone connected to said first zone, vigorously agitating and cooling the melted first metal composition to solidify a portion thereof and to form primary solids comprising discrete degenerate dendrites or nodules while preventing the formation of interconnected dendritic networks in said agitation zone, said primary solid comprising up to about 80 weight percent of said liquid-solid metal composition, passing said liquid-solid metal composition from said agitation zone onto a belt which is moving relative to an outlet from said agitation zone, cooling the portion of said liquid-metal composition in contact with said belt to solidify a portion thereof, passing said partially solidified metal composition into a forming zone including a rotor that contacts said mixture wherein said partially solidified metal composition is formed under pressure and controlling the fraction solid of said mixture of liquid-solid metal, the deformation force in said forming zone and the rate at which said liquid-solid metal enters said forming zone in order to minimize intradendritic or intergranular cracks in the shaped composition while minimizing or preventing flow of said mixture outside of said forming zone.

2. The method of claim 1 wherein the heated metal composition is cooled to form between 30 and 80 weight percent primary solid prior to being removed from said agitation zone.

3. The process of any one of claims 1 or 2 wherein said belt comprises an endless moving belt.

4. The process of any one of claims 1 or 2 wherein said partially solidified metal composition is formed under pressure into a sheet.

5. The process of any one of claims 1 or 2 wherein said partially solidified metal composition is formed under pressure into a rod.

* * * * *